United States Patent [19]

Higby

[11] 4,164,329

[45] Aug. 14, 1979

[54] CHIPPER ROLLER AND KNIVES THEREFOR

[75] Inventor: Philip J. Higby, Towaco, N.J.

[73] Assignee: Lee Heydenreich, Essex Fells, N.J.

[21] Appl. No.: 858,534

[22] Filed: Dec. 8, 1977

Related U.S. Application Data

[63] Continuation of Ser. No. 747,218, Dec. 3, 1976, abandoned.

[51] Int. Cl.[2] ..... B02C 18/06; B02C 18/18

[52] U.S. Cl. ..... 241/294; 83/853; 241/296; 407/42; 407/113

[58] Field of Search ..... 241/221, 282, 293–296, 241/298; 407/7, 58, 59, 61, 62, 113, 114, 36, 42; 144/172, 230, 241; 30/115, 301; 83/853

[56] References Cited

U.S. PATENT DOCUMENTS

| | | | |
|---|---|---|---|
| 2,551,167 | 5/1951 | Rolland | 407/7 |
| 2,664,617 | 1/1954 | Kralowetz | 407/113 X |
| 2,885,766 | 5/1959 | Ernst et al. | 407/7 |
| 3,213,716 | 10/1965 | Getts | 29/105 A X |
| 3,378,210 | 4/1968 | Bambach | 241/294 X |
| 3,540,103 | 11/1970 | Saari | 407/59 X |
| 3,656,220 | 4/1972 | Dupuis | 407/17 |
| 3,786,540 | 1/1974 | Lundgren | 407/114 X |

*Primary Examiner*—Howard N. Goldberg
*Attorney, Agent, or Firm*—Watson, Leavenworth, Kelton & Taggart

[57] ABSTRACT

A chipper roller for a two-stage grinding machine has removable circular knives spaced axially and circumferentially in an array following a helical path of two turns about the surface of the roller. Each knife is in the form of a disc with a central aperture for accepting a fastening element and with a cutting edge on one side adjacent its periphery and an annular groove on the same side adjacent said edge creating a rake which cooperates with the walls of the groove to produce curls from chunks of material. The knives are fastened to the roller in recesses with only a minor portion of the knife projecting above the surface of the roller. Upon dulling of the exposed edge the knife can be rotated to bring a sharp section of the cutting edge into operation.

7 Claims, 8 Drawing Figures

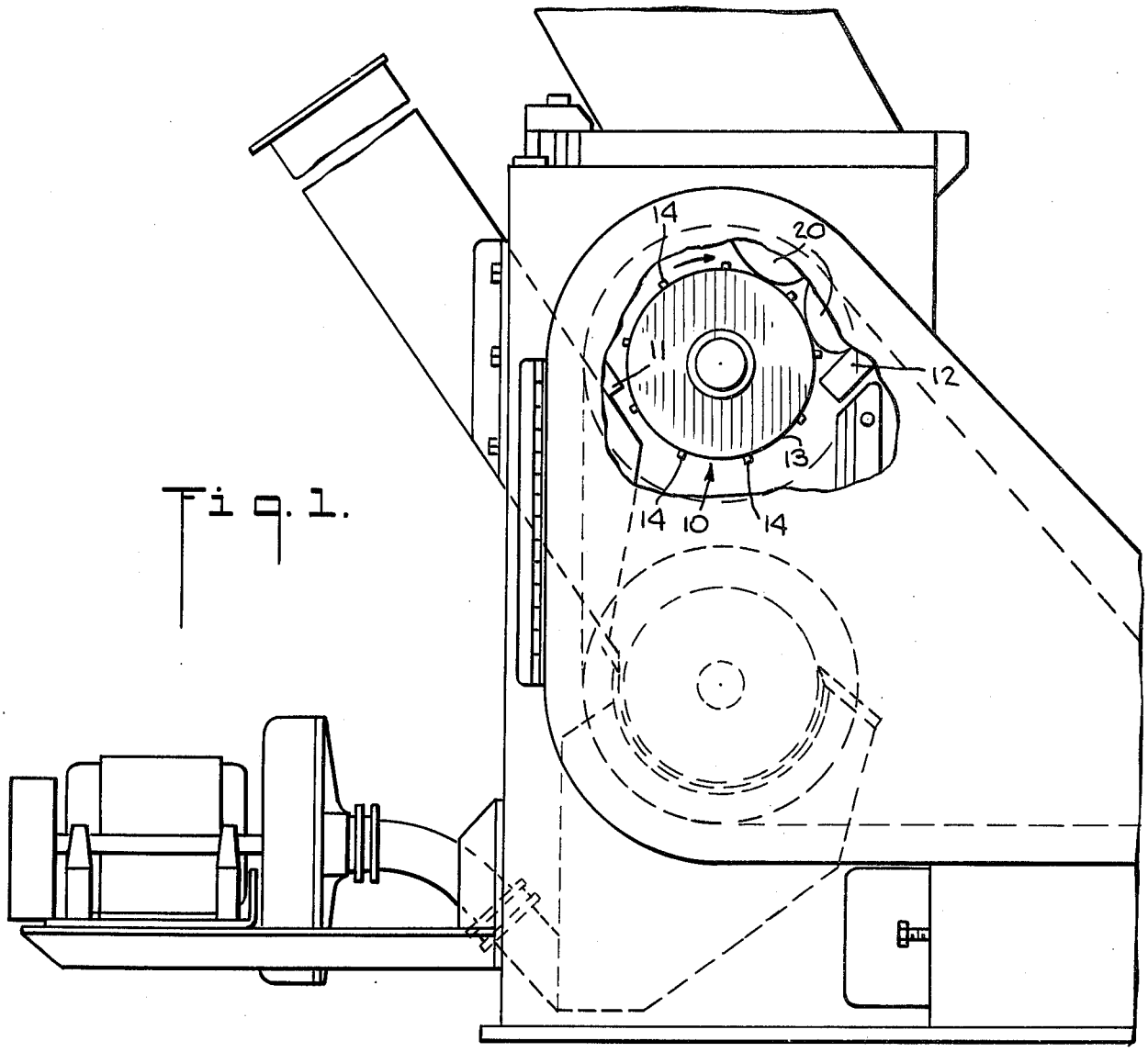
Fig. 1.
Fig. 2.
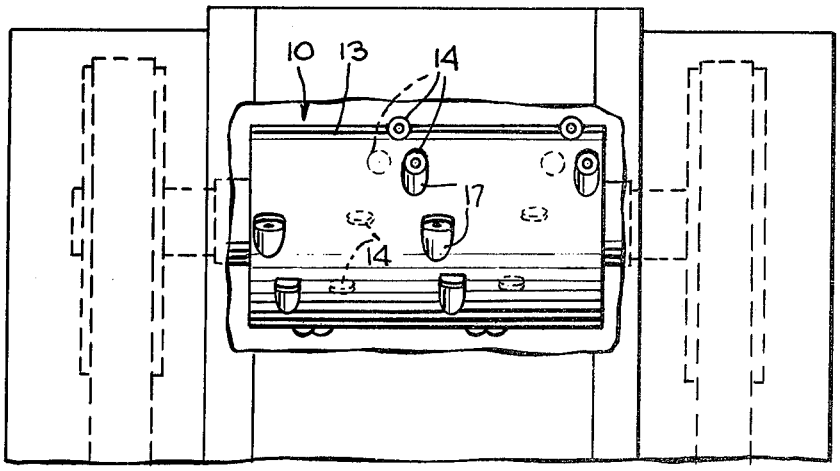

CHIPPER ROLLER AND KNIVES THEREFOR

This is a continuation of application Ser. No. 747,218, filed Dec. 3, 1976, now abandoned.

The present invention relates to a chipper roller for use in a two-stage machine for granulating bodies of plastic and like material. More particularly, it relates to the first stage roller for producing curls of such material which are further reduced in size by the second stage to the desired granular dimension.

A two-stage grinding machine for reducing plastic and like chucks into granulate is described in U.S. Pat. No. 3,378,210 issued Apr. 16, 1968 for "Machine for Cutting Plastic Chunks into Granulate" on an application of Fritz J. Bamback and assigned to the same assignee as the present application. The machine described in said patent has an upper chamber for receiving plastic chunks, a rotatable roller in the upper chamber having knives spaced axially and circumferentially along its surface and a concave recess in front of each knife, the knives cooperating with a shearing plate to cut curlings from said chunks, the curlings being accommodated in such recesses and then delivered to the second stage. In the second stage there is a second chamber having at least two rotating cutting blades, a pair of cooperating shearing plates, and a perforated screen at the base, the curlings being reduced to pellet or granulate size so as to pass through the screen into a collecting trough from which they are removed by suction or fan means. An auxiliary hopper for feeding smaller chucks or segments directly to the second chamber is also provided.

An object of the present invention is to provide an improved roller and knives therefor for the first stage having numerous advantages over the roller and knives described in the aforesaid patent. For example, whereas the knives on the upper roller in said patented machine are constructed such that the entire cutting edge is in use at any one time necessitating removal of the knife and sharpening every time the edge dulls, the knives constructed in accordance with the present invention each have only a fraction of their total cutting edge in use at any one time which, when it dulls, can be replaced with a sharp section by merely repositioning the knife on the roller. This extends the interval between which sharpening operations must be performed. It reduces the down time of the machine and, in fact, gives rise to a roller which is more economical to fabricate.

A further object of the present invention is to provide a first stage roller for the aforesaid type of grinding machine which produces curls with better size and shape.

In accordance with one aspect of the invention there is provided a chipper roller, for use in a two-stage machine for granulating bodies of plastic and like material, having a cylindrical surface from which projects an axially and circumferentially spaced array of replaceable knives, characterized in that each of said knives consists of a circular disc having a cutting edge on one side at its periphery and a circumferential groove in said one side adjacent said cutting edge providing a rake at an angle greater than 40° which cooperates with the walls of said groove such that said knives cut curls from said bodies of material, the cross-section of said groove having a smoothly curving contour free from slope discontinuities and reversals, and said disc are each removably mounted in respective recesses on said roller with a portion of said disc projecting beyond said surface and with said one side of said disc facing at least generally in the direction of intended rotation of said roller.

In accordance with another aspect of the invention there is provided a knife for a chipper roller of a two-stage machine for granulating bodies of plastic and like material, said knife consisting of a circular disc having a cutting edge on one side at its periphery for cutting said plastic, a circumferential groove of circular cross-section in said one side adjacent said cutting edge providing a rake at an angle greater than 40° which cooperates with the walls of said groove such that said knife when installed in said chipper roller in a granulating machine upon operation cuts curls from a body of plastic or like material, the cross-section of said groove having a smoothly curving contour free from slope discontinuities and reversals, and a central aperture for accommodating a fastening element for securing said knife to said chipper roller.

The invention will be better understood after reading the following detailed description of the presently preferred embodiment thereof with reference to the appended drawings in which:

FIG. 1 is a side elevational view partially broken away of a two-stage grinding machine incorporating the subject roller;

FIG. 2 is a fragmentary front elevational view of the machine of FIG. 1 with parts broken away to show the roller in plan view;

Figure 3:
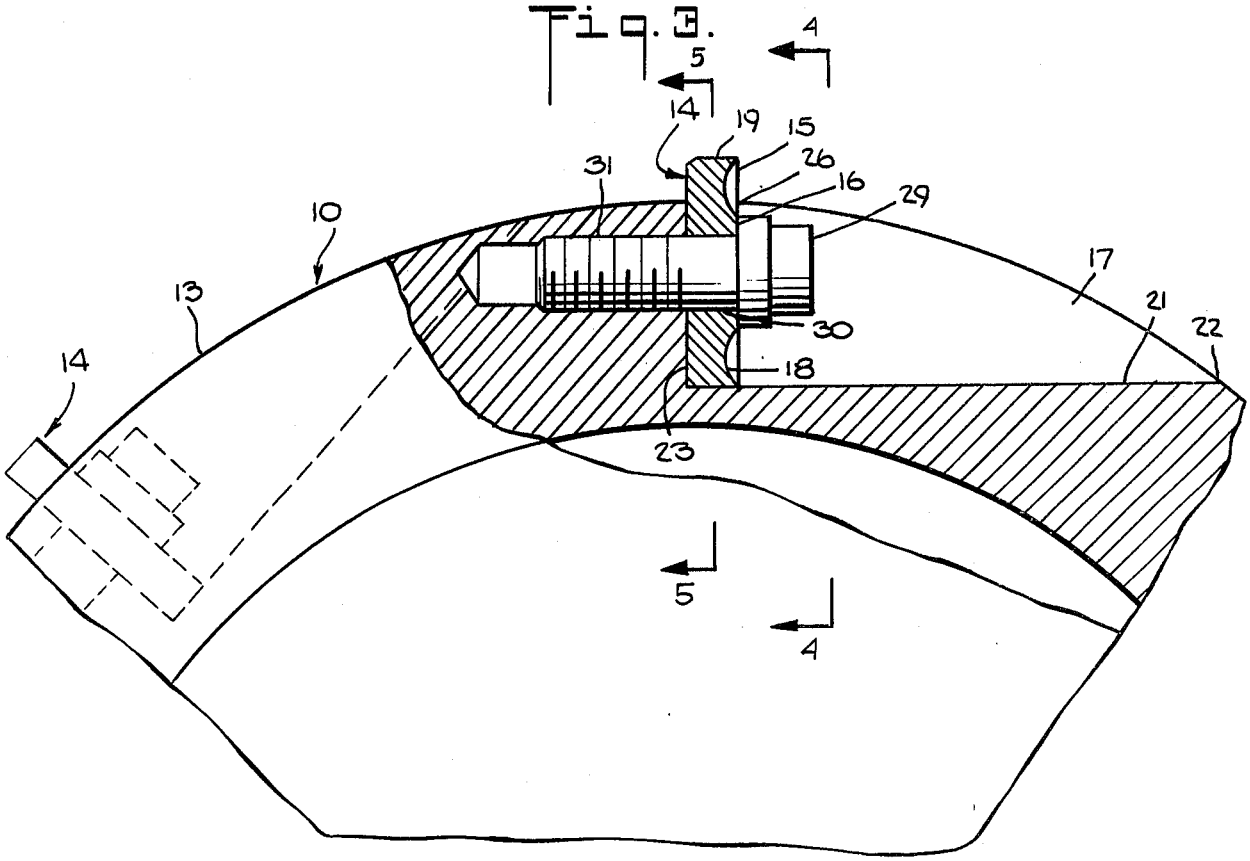
FIG. 3 is an enlarged fragmentary cross-sectional view of one of the curling knives mounted in the roller.

Reference should now be had to the drawings wherein the same reference numerals are used throughout the various figures to designate the same or similar parts. For a detailed explanation of the construction and operation of a two-stage grinding machine in which the roller of the present invention can be incorporated, reference should be had to the aforesaid Letters Patent. The following description will be limited to the improved chipper roller which embodies the present invention and which is designated in the drawings generally by the reference numeral 10. The roller 10 is located in the upper chamber cooperating with shearing plates 11 and 12 and has a cylindrical surface 13 from which projects an axially and circumferentially spaced array of replaceable knives 14. Each of the knives 14 consists of a circular disc having a cutting edge 15 on one side, namely, the side 16, at the periphery of the disc. The discs 14 are each removably mounted in respective recesses 17 on the roller 10 with a portion of the disc projecting beyond the surface 13 and with the one side 16 of the disc 14 facing at least generally in the direction of intended rotation of the roller 10 which, as viewed in FIG. 1, is clockwise.

Each of the discs 14 has a circumferential groove 18 in the one side, adjacent the cutting edge 15 providing a rake where the groove wall 18 merges with the peripheral wall 19 of the disc 14 at the edge 15. The groove 18 is circular in cross-section and its walls cooperate with the rake such that the knives 14 cut curls from the bodies of material such as the chunks 20 shown in FIG. 1.

Figure 4:
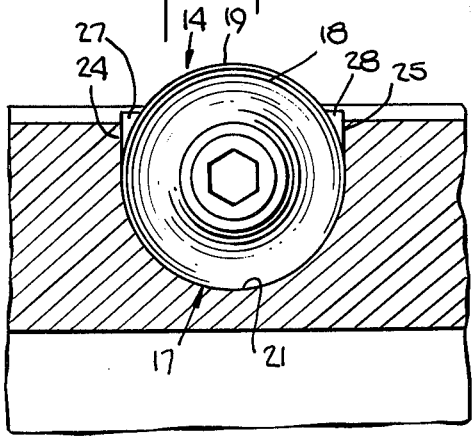
FIG. 4 is a sectional view taken along line 4—4 in FIG. 3 showing a knife in front elevation.
Figure 5:
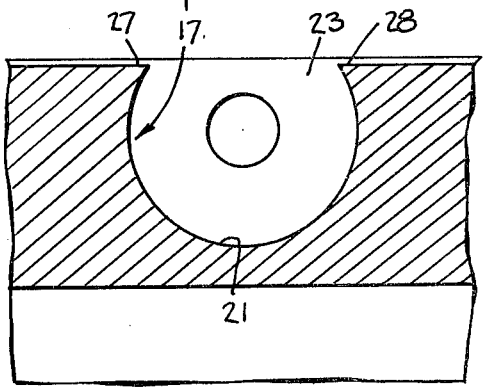
FIG. 5 is a sectional view taken along line 5—5 in FIG. 3 with the knife removed to show a detail of the recess.
Figure 6:
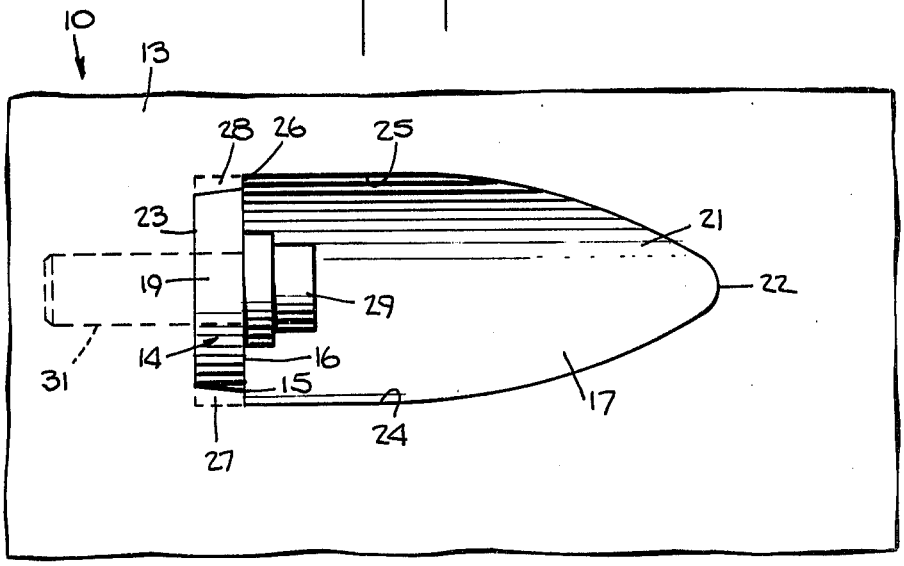
FIG. 6 is a fragmentary top plan view of one of the roller recesses with a knife installed.

The recess 17 for each knife 14 has a cylindrical bottom wall 21 extending from the mouth or entry point 22 along a chord of the roller to the radial wall 23 with the latter lying in a plane containing the axis of the roller. Above the horizontal centerline of the recess 17 as viewed in FIG. 4 of the drawings its side walls 24 and 25 are planar and normal to the roller axis commencing at the point 26 (see FIG. 3) coinciding with the front face 16 of the knife 14 and extending in front of said knife. Between the point 26 and the wall 23 the walls 24 and 25 are cylindrical providing overhanging portions 27 and 28 which prevent displacement of the knife 14 in the radial direction from the recess 17 in the roller 10. The recess 17 is produced most conveniently by bringing in a boring and broaching tool along the desired chord of the roller 10 until it reaches the wall 23, then backing out a distance equal to the thickness of the disc 14 and thereafter exiting laterally.

The knife 14 is installed by dropping axially into the recess 17 up to the wall 23 and then installing a bolt 29 through a central aperture 30 in disc 14 into a threaded bore 31 in roller 10 to fasten the disc 14 in place.

Each of the knives 14 is disposed in an identical bore 17. The knives are preferably located in an array following a helical curve of two turns around the surface of the roller. Each knife is displaced circumferentially 40° from the next adjacent knife in a presently preferred embodiment containing eighteen knives on a roller having a surface diameter of about 11½ inches. This arrangement locates the knives in pairs along each of ten longitudinal elements of the roller with adjacent knives spaced axially at seventeen equal increments of approximately one inch along a roller about 18⅝ inches long.

Figure 7:
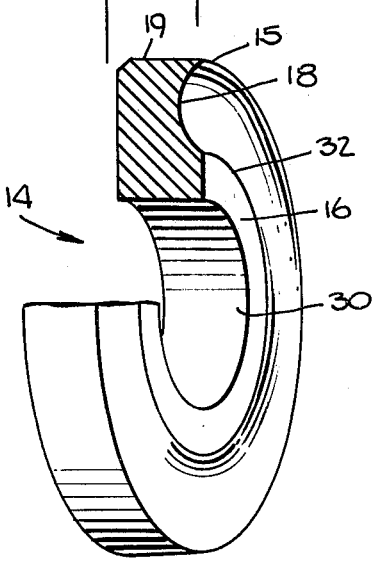
FIG. 7 is a perspective view of a knife.
Figure 8:
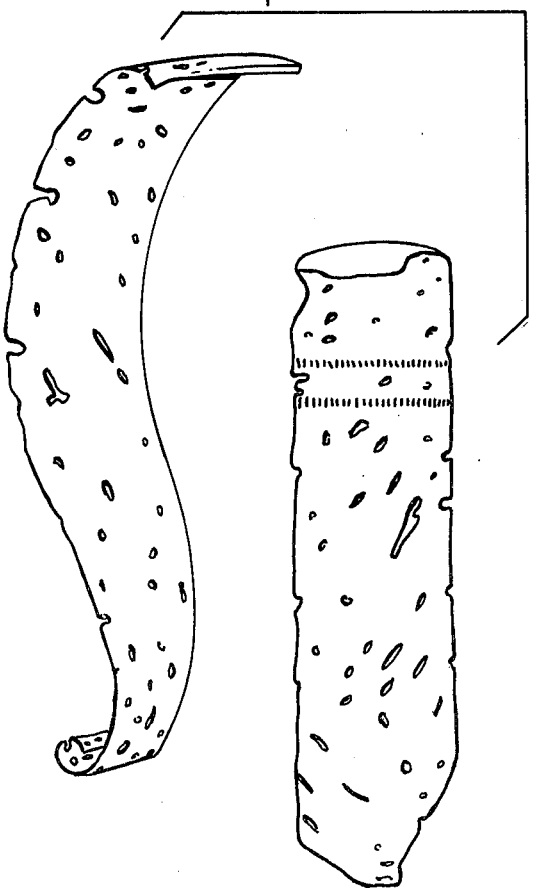
FIG. 8 is a perspective view of two "curls" as produced by the upper roller of the present invention.

Referring specifically to FIG. 7, a satisfactory knife for the aforesaid 11 ½ inch diameter roller can have a diameter of about 1½ inches with the groove 18 having a radius of about ¼ inch and a depth below the surface 16 such that the diameter of the inner margin 32 of the groove is about ¾ inches. This will yield a rake at an angle of about 48°. If the disc 14 has a thickness of about 5/16 inches the offset of the cutting edge 15 in front of the radial plane of the wall 23 will reduce the effective rake angle to something approaching 45° and will automatically provide a slight clearance angle for the peripheral surface 19 of the knife.

In operation the projecting portion of the knife 14, which extends in the presently preferred embodiment about ¼ inch above the surface 13 of the roller 10, will slice a ribbon-like piece of material from the chunks 20 curling it into the corresponding recess 17 and then depositing it into the lower chamber of the grinder for further subdivision. When the exposed portions of the knives 14 become dull, the fastening bolts can be loosened and the knives rotated to bring a sharp section of the edge 15 above the surface of the roller.

It has been found that the subject roller construction is more economical to fabricate than the former construction, requires less power to operate, reduces the down time of the grinder for knife sharpening and is less susceptible to jamming.

Having described the presently preferred embodiment of the invention it will be apparent to those skilled in the subject art that various changes in construction can be effected without departing from the true spirit of the invention as defined in the appended claims. For example, the number and axial and circumferential spacing of the knives can be varied, different fastening means can be employed, the rake angle can be altered, the size of the knives can be changed and so forth.

What is claimed is:

1. A chipper roller, for use in a two-stage machine for granulating bodies of plastic and like material, having a cylindrical surface from which projects an axially and circumferentially spaced array of replaceable knives, characterized in that each of said knives consists of a circular disc having a cutting edge on one side at its periphery and a circumferential groove in said one side adjacent said cutting edge providing a rake at an angle greater than 40° which cooperates with the walls of said groove such that said knives cut curls from said bodies of material, the cross-section of said groove having a smoothly curving contour free from slope discontinuities and reversals, and said discs are each removably mounted in respective recesses on said roller with a portion of said disc projecting beyond said surface and with said one side of said disc facing at least generally in the direction of intended rotation of said roller.

2. A chipper roller according to claim 1, characterized in that said groove has a circular cross-section.

3. A chipper roller according to claim 1, characterized in that the angle of said rake is about 48°.

4. A chipper roller according to claim 3, characterized in that said groove has a circular cross-section.

5. A knife for a chipper roller of a two-stage machine for granulating bodies of plastic and like material, said knife consisting of a circular disc having a cutting edge on one side at its periphery for cutting said plastic, a circumferential groove of circular cross-section in said one side adjacent said cutting edge providing a rake at an angle greater than 40° which cooperates with the walls of said groove such that said knife when installed in said chipper roller in a granulating machine upon operation cuts curls from a body of plastic or like material, the cross-section of said groove having a smoothly curving contour free from slope discontinuities and reversals, and a central aperture for accommodating a fastening element for securing said knife to said chipper roller.

6. A knife according to claim 5, characterized in that the angle of said rake is about 48°.

7. A machine for granulating bodies of plastic and like material comprising in combination a chipper roller with a cylindrical surface from which projects an axially and circumferentially spaced array of replaceable knives mounted in a chamber below a hopper for randomized production of chips from chunks of said material fed to said hopper, said knives each consisting of a circular disc having a cutting edge on one side at its periphery and a circumferential groove in said one side adjacent said cutting edge providing a rake at an angle greater than 40° which cooperates with the walls of said groove such that said knives cut curls from said bodies of material, the cross-section of said groove having a smoothly curving contour free from slope discontinuities and reversals, and said discs are each removably mounted in respective recesses on said roller with a portion of said disc projecting beyond said surface and with said one side of said disc facing at least generally in the direction of rotation of said roller.

* * * * *